US011124915B2

(12) United States Patent
Bicic

(10) Patent No.: US 11,124,915 B2
(45) Date of Patent: Sep. 21, 2021

(54) DOOR-LOCK WITH A HOOK DETECTION SLIDER WITH ADDITIONAL SECURITY

(71) Applicant: Illinois Tool Works Inc., Glenview, IL (US)

(72) Inventor: Bojan Bicic, Slap Ob Idrijci (SI)

(73) Assignee: Illinois Tool Works Inc., Glenview, IL (US)

( * ) Notice: Subject to any disclaimer, the term of this patent is extended or adjusted under 35 U.S.C. 154(b) by 199 days.

(21) Appl. No.: 16/466,395

(22) PCT Filed: Dec. 14, 2017

(86) PCT No.: PCT/US2017/066384
§ 371 (c)(1),
(2) Date: Jun. 4, 2019

(87) PCT Pub. No.: WO2018/118637
PCT Pub. Date: Jun. 28, 2018

(65) Prior Publication Data

US 2019/0292714 A1 Sep. 26, 2019

(30) Foreign Application Priority Data

Dec. 23, 2016 (IT) ..... 102016000130683

(51) Int. Cl.
*D06F 39/14* (2006.01)
*D06F 37/42* (2006.01)
(Continued)

(52) U.S. Cl.
CPC ..... *D06F 39/14* (2013.01); *D06F 37/42* (2013.01); *E05C 19/024* (2013.01);
(Continued)

(58) Field of Classification Search
None
See application file for complete search history.

(56) References Cited

U.S. PATENT DOCUMENTS

2007/0209411 A1* 9/2007 Lim ..... E05B 17/22 70/263

FOREIGN PATENT DOCUMENTS

WO 2012042551 A1 4/2012
WO 2013181289 A1 12/2013
(Continued)

OTHER PUBLICATIONS

International Search Report for PCT/US2017/066384; dated Mar. 8, 2018.

*Primary Examiner* — Cristi J Tate-Sims
(74) *Attorney, Agent, or Firm* — Boyle Fredrickson, S.C.

(57) ABSTRACT

A door-lock for household appliances, comprising a casing (12) having an opening (14) for the insertion of a hook (15) carried by a door of a household appliance, a cam (16) rotatable between a retaining position and a release position, a locking slider (20) cooperating with said cam (16) and movable between an unlocking position and a locking position, wherein in the locking position the locking slider (20) locks the cam (16) in the retaining position, an electromagnetic device comprising a housing (70) and a locking pin (28) for locking the locking slider (20) in the locking position, a door sensing slider (32) movable between an open door position and a closed door position, and a hook sensing slider (74) movable between an extracted position and a retracted position, wherein the hook sensing slider (74) has a projection (82) that prevents the movement of the door sensing slider (32) from the open door position towards the closed door position when the hook sensing slider (74) is in the extracted position, wherein the hook sensing slider (74) has a safety portion (86) that, in an abnormal condition in which the integrity of the cam support (11) is compromised, comes into contact with a side (94) of the housing (70) and
(Continued)

prevents movement of the hook sensing slider (74) from the extracted position towards the retracted position.

10 Claims, 4 Drawing Sheets

(51) Int. Cl.

| | |
|---|---|
| ***E05C 19/02*** | (2006.01) |
| *E05B 47/06* | (2006.01) |
| *E05B 47/00* | (2006.01) |
| *E05C 3/24* | (2006.01) |

(52) U.S. Cl.
CPC ... *E05B 47/0603* (2013.01); *E05B 2047/0067* (2013.01); *E05B 2047/0068* (2013.01); *E05C 3/24* (2013.01)

(56) References Cited

FOREIGN PATENT DOCUMENTS

| | | | |
|---|---|---|---|
| WO | 2016102565 | A1 | 6/2015 |
| WO | 2015140306 | A1 | 9/2015 |

* cited by examiner

DOOR-LOCK WITH A HOOK DETECTION SLIDER WITH ADDITIONAL SECURITY

FIELD OF THE INVENTION

The present invention relates to a door-lock for household appliances such as washing machines, dryers, washer-dryers and the like.

BACKGROUND OF THE INVENTION

A door-lock for household appliances is an electro-mechanical device adapted to lock the machine door in the closed position. In some cases, the door-lock is also provided with a door detection circuit which provides information on the state of open/closed door.

WO2016102565 discloses a door-lock for household appliances including:

- a casing having an opening for the insertion of a hook carried by the door of the appliance,
- a cam rotatable relative to the casing about an axis of rotation between a retaining position and a release position, wherein in the retaining position the cam is adapted to lock the hook in a closed door position,
- a locking slider cooperating with the cam and movable between an unlocked position and a locked position, and
- an electromagnetic actuator comprising a locking pin to lock said locking slider in the lock position.

The locking slider has a projection that comes into contact with the housing to define a position of engagement by the locking pin. In an abnormal condition, as in the case in which the casing is dismantled or its integrity is compromised, the locking slider moves relative to its normal operating position and in this condition, the locking pin can not engage the locking slider.

A drawback of the door-lock according to WO2016102565 is that even in an abnormal situation the locking slider enables sending electrical pulses to the electromagnetic actuator that actuates the locking pin. Therefore, the control unit continues to send electrical pulses even in abnormal conditions, generating noise and heating of the actuator. Another drawback is that, in abnormal conditions, despite the appliance door is closed, the door detection circuit provides the appliance control unit with a closed door signal.

OBJECT AND SUMMARY OF THE INVENTION

The object of the present invention is to provide an improved door-lock which overcomes the problems of the prior art.

According to the present invention, this object is achieved by a door-lock having the features forming the subject of Claim 1.

The claims form an integral part of the teachings provided in relation to the invention.

BRIEF DESCRIPTION OF THE DRAWINGS

The present invention will now be described in detail with reference to the accompanying drawings, given purely by way of non-limiting example, in which.

DETAILED DESCRIPTION

With reference to the figures, 10 designates a door-lock for household appliances according to the present invention. The door-lock 10 comprises a casing 12 having an opening 14 for the insertion of a hook 15 carried by the appliance door.

Figure 2:
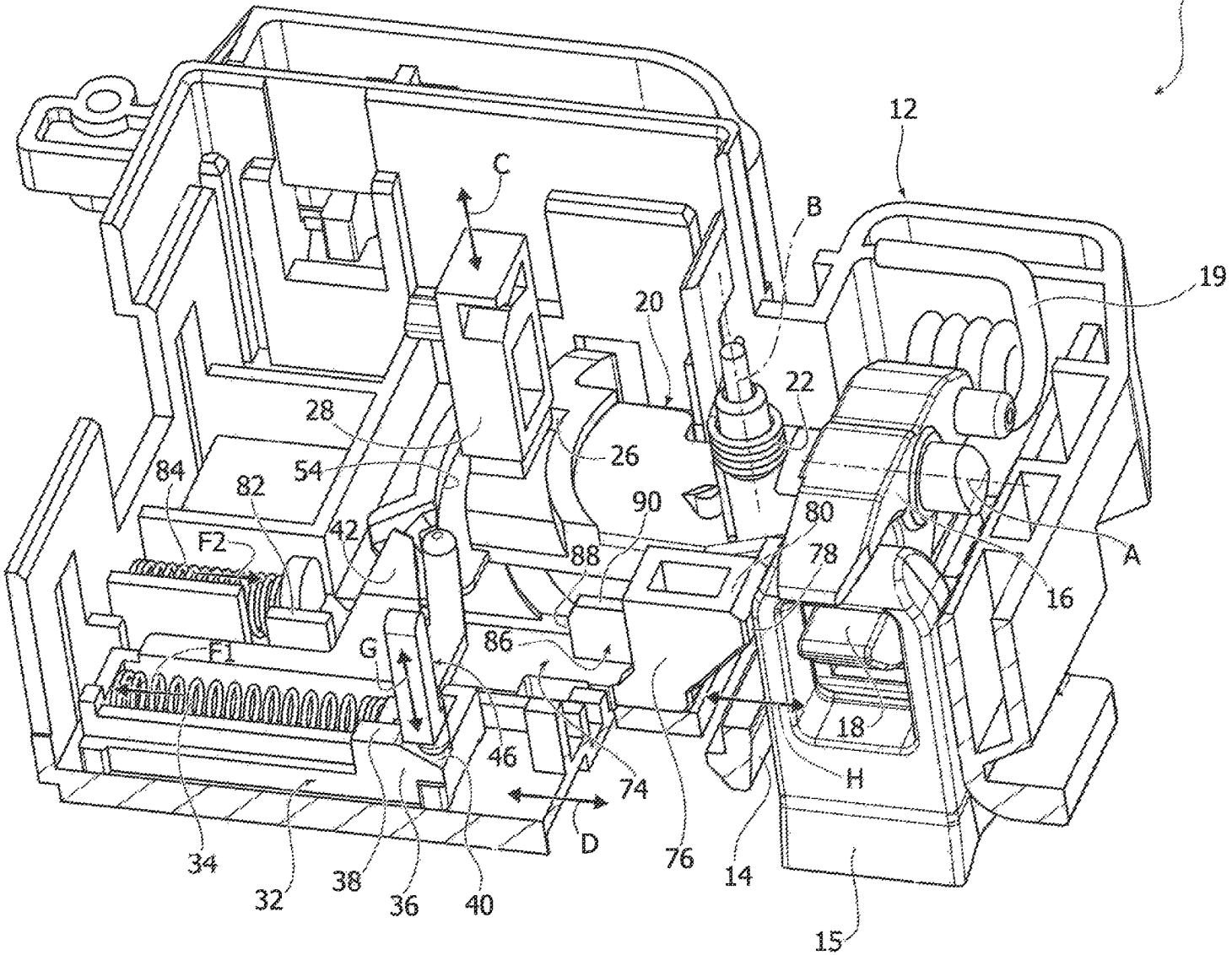

The door-lock 10 comprises a cam support 11 which is snap engaged on the casing 12. The door-lock 10 also comprises an electro-magnetic device including a housing 70 and a cover 13. In FIG. 2 the cam support 11, the housing 70 and the cover 13 have been removed to illustrate the internal components.

Figure 4:
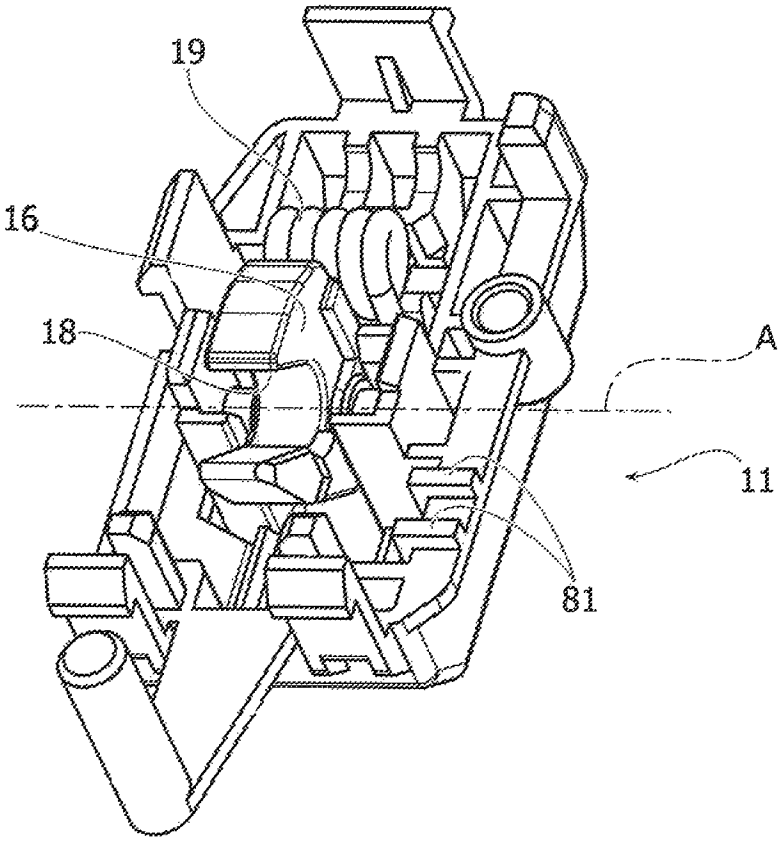
FIG. 4 is a perspective view in the direction indicated by arrow IV in FIG. 1.

With reference to FIG. 4, the cam support 11 carries a cam 16 rotatable about a first axis A between a retaining position and a release position. The cam 16 has an engaging portion 18 which cooperates with the hook 15. The cam 16 is associated with a spring 19 having a bistable function.

When the appliance door is open the spring 19 pushes the cam 16 to the release position and when the appliance door is closed the spring 19 pushes the cam 16 to the retaining position.

When the hook 15 penetrates into the opening 14 of the casing 12 following the closing of the door, the hook 15 engages in the engagement portion 18 and the cam 16 rotates about axis A from the release position to the retaining position.

The door-lock 10 includes a locking slider 20 that is rotatable with respect to the casing 12 about a second axis B oriented at 90° with respect to the first axis A. The locking slider 20 is rotatable about the axis B between a locking position and an unlocking position. A spring 22 pushes the locking slider 20 toward the locking position.

With reference to FIG. 2, a locking pin 28 controlled by an electromagnetic actuator (not shown) is arranged inside the housing 70. The functional connection between the electromagnetic actuator and the locking pin 28 is described, for example, in WO2013181289. The locking pin 28 is movable in a rectilinear direction C parallel to the second axis B and is movable between a release position and a locking position. The locking pin 28 in the locking position engages a seat 26 of the locking slider 20. When the locking pin 28 engages the seat 26 of the locking slider 20, the locking slider 20 is locked in the locking position.

The door-lock 10 comprises a door sensing slider 32 movable along a rectilinear direction D between an open door position and a closed door position. A first spring 34, for example a helical compression spring, is arranged between the casing 12 and the door sensing slider 32 and applies to the door sensing slider 32 an elastic force in the direction indicated by the arrow F1 which tends to push the door sensing slider 32 towards the closed door position. The door sensing slider 32 has a portion 36 having an upper surface 38 and an inclined surface 40. A door sensing pin 46 is movable in the housing 70 along a rectilinear direction G orthogonal to the direction D between a raised position corresponding to the open door position of the door sensing slider 32 and a lowered position corresponding to the closed door position of the door sensing slider 32. The door sensing pin 46 cooperates with a door sensing switch (not shown) which pushes elastically the door sensing pin 46 towards the portion 36. In the open door position of the door sensing slider 32, the door sensing pin 46 abuts on the upper surface 38 of portion 36 and maintains the door sensing switch in an open state. In the closed door position of the door sensing slider 32 the door sensing pin 46 abuts on the inclined surface 40 of portion 36 and the door sensing switch switches to a closed state. A door sensing switch of this type is described in the WO2013181289.

The door sensing slider 32 has an integral arm 42 projecting in the direction orthogonal to the direction D and which cooperates with a retaining surface 54 of the locking slider 20. When the locking slider 20 is in the locked position, the arm 42 of the door sensing slider 32 is disengaged from the retaining surface 54 and the door sensing slider 32 is pushed by the spring 34 to the closed door position. When the locking slider 20 is in the unlocked position, the arm 42 is engaged by the retaining surface 54 of the lock slider 20 and is retained in the open door position against the force F1 of the spring 34.

The door-lock 10 comprises a hook sensing slider 74 movable along a rectilinear position H parallel to direction D between an extracted position and a retracted position. A second spring 84, constituted for example by a helical compression spring, is arranged between the casing 12 and the hook sensing slider 74, and applies to the hook sensing slider 74 a second elastic force F2 which tends to push the hook sensing slider 74 towards the extracted position. The hook sensing slider 74 has a head 76 with a front surface 78 which is intended to rest against a side of the hook 15 and an upper surface 80 which rests against a portion 81 (FIG. 4) of the inner surface of the cam support 11.

The hook sensing slider 74 has a projection 82 facing the detection arm 42 of the slider 32. When the door hook 15 is disengaged from the casing 12 the hook sensing slider 74 is in the extracted position under the force F2 of the spring 84. In this position the projection 82 bears against the arm 42 and keeps the door sensing slider 32 in the open door position. When the hook 15 is inserted in the casing 12 the side of the hook 15 comes into contact with the front surface 78 of the hook sensing slider 74 and the hook sensing slider 74 is pushed toward the retracted position.

When the hook sensing slider 74 is in the retracted position the door sensing slider 32 is free to move to the closed door position under the force F1 of the first spring 34 when the arm 42 of the door sensing slider 32 is disengaged from the retaining surface 54, that is when the locking slider 20 is in the locked position.

Figure 1:
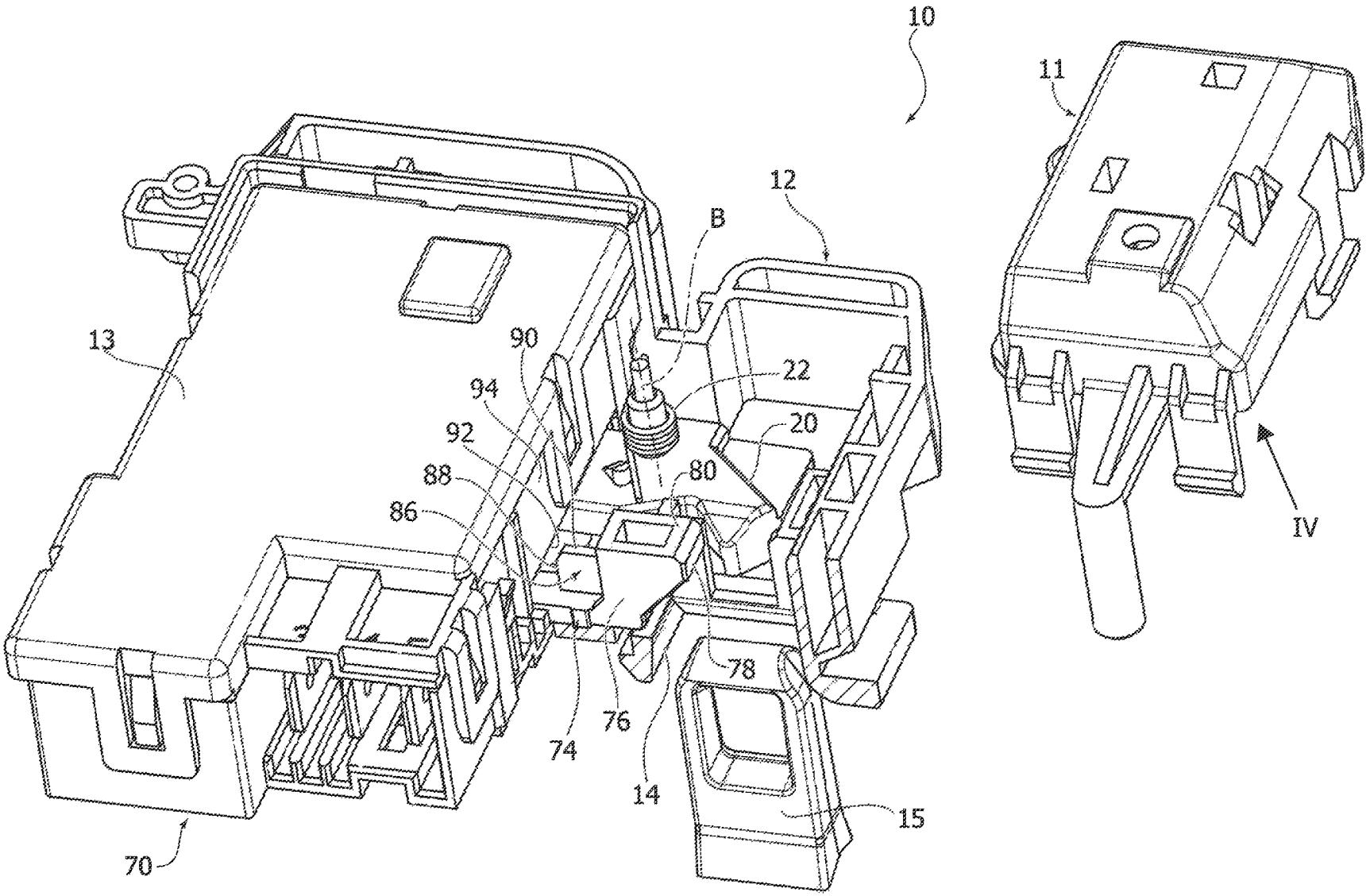
FIGS. 1 and 2 are perspective views of a door-lock according to the present invention with some components removed.

With reference to FIGS. 1 and 2, the hook sensing slider 74 has a safety portion 86 adjacent to the head 76. In the illustrated example the safety portion 86 has the shape of a rib having a front surface 88 and an upper surface 90.

FIG. 1 illustrates the position of the hook sensing slider 74 during the insertion of the hook 15 in a normal condition, in which the cam support 11 is intact and correctly assembled. In this condition, the upper surface 80 of the head 76 bears against cam support 11 and retains the hook sensing slider 74 in a horizontal position. In this position, the upper surface 90 of the safety portion 86 is below a lower edge 92 of a side 94 of the housing 70. Therefore, the insertion of the hook 15 in the casing 12 moves the hook sensing slider 74 towards the retracted position. The safety portion 86 passes beneath the edge 92 of the housing 70 and does not hinder the movement of the hook sensing slider 74 toward the retracted position. When the hook 15 is completely inserted the hook sensing slider 74 is in the retracted position. When the hook sensing slider 74 is in the retracted position the door sensing slider 32 is free to move to the closed door position when the locking slider 20 is rotated to the locking position.

Figure 3:
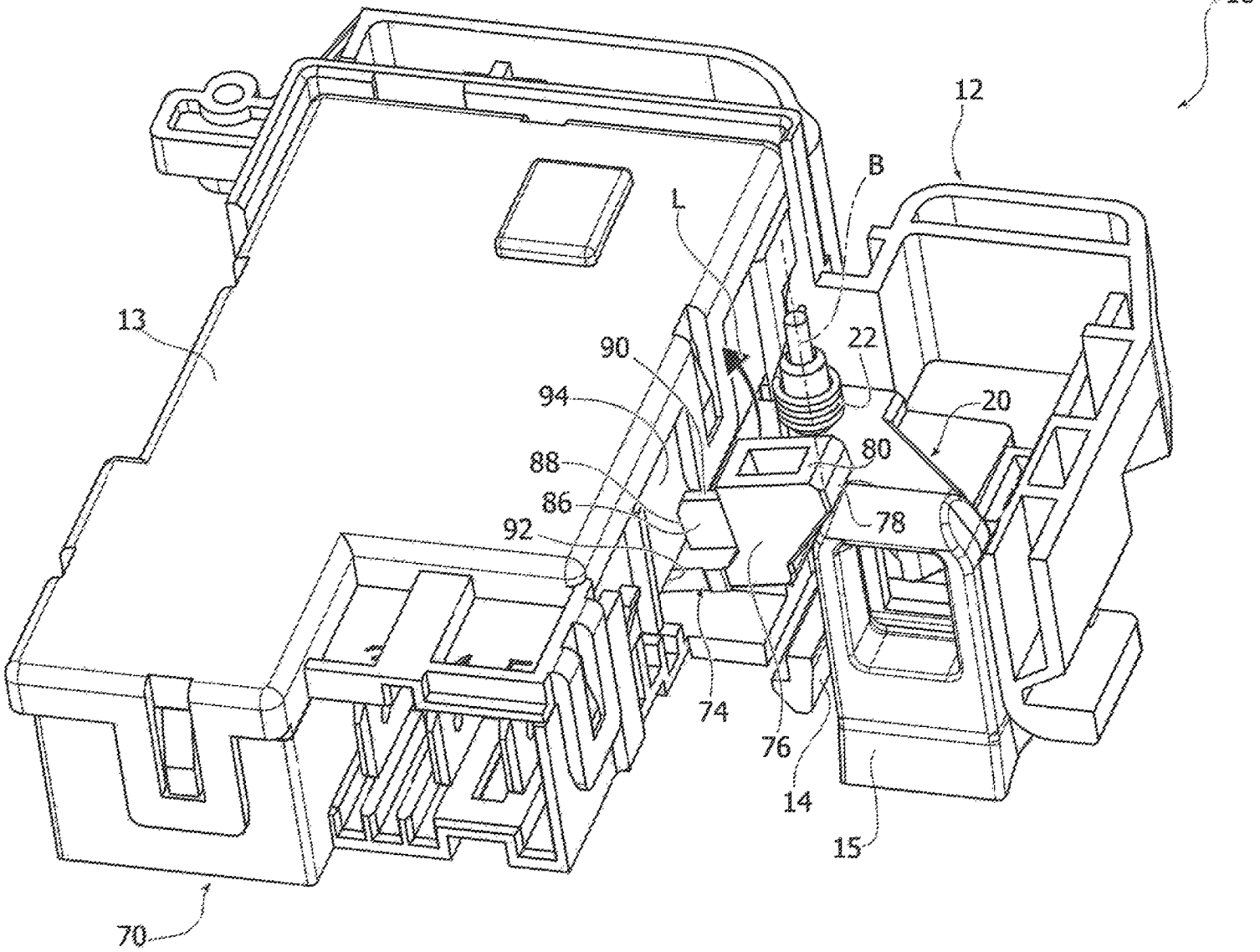
FIG. 3 is a perspective view corresponding to FIG. 1 and illustrating the door-lock according to the present invention in an abnormal condition.

FIG. 3 illustrates the position of the hook sensing slider 74 during the insertion of the hook 15 in an abnormal condition, in which the cam support 11 is not properly assembled or its integrity is compromised. In this condition, during the insertion of the hook 15 in the casing 12 the hook sensing slider 74 tilts in the direction indicated by arrow L as shown in FIG. 3 because the upper surface 80 of the head 76 is not resting against the cam support 11. In this position of the hook sensing slider 74 the upper surface 90 of the safety portion 86 extends above the lower edge 92 of the housing 70. Therefore, during the movement of the hook sensing slider 74 towards the retracted position the front surface 88 of the safety portion 86 interferes with the side 94 of the housing 70. Therefore, in the condition where the integrity of the cam support 11 is compromised, for example due to braking or detachment of the cam support 11, the hook sensing slider 74 is prevented from reaching the retracted position. Consequently, the door sensing slider 32 remains in the open door position even when the locking slider 20 rotates to the locking position.

Therefore, the safety portion 86 performs an additional safety feature, for the fact that prevents the door detection slider 32 to move toward the closed door position in an abnormal condition in which the integrity of the casing 12 is compromised for example due to a rupture or a partial disassembly of the cam support 11. Therefore, in an abnormal condition the door sensing switch remains permanently open, regardless of the position of the locking slider 20. Any activation command of the machine is therefore prevented and no electric pulses are sent to the electromagnetic actuator which controls the locking pin 28.

The invention claimed is:

1. A door-lock for household appliances, comprising:

a casing having an opening for the insertion of a hook carried by a door of a household appliance, a cam support carrying a cam rotatable between a retaining position and a release position, a locking slider cooperating with the cam and movable between an unlocking position and a locking position, wherein in the locking position the locking slider locks the cam in the retaining position, an electro-magnetic device comprising a housing and a locking pin for locking the locking slider in the locking position, a door sensing slider movable between an open door position and a closed door position, and a hook sensing slider movable between an extracted position and a retracted position, wherein the hook sensing slider has a projection that prevents the movement of the door sensing slider from the open door position towards the closed door position when the hook sensing slider is in the extracted position, wherein the hook sensing slider has a safety portion that, in an abnormal condition in which the integrity of the cam support is compromised, comes into contact with a side of the housing and prevents movement of the hook sensing slider from the extracted position towards the retracted position.

2. A door-lock according to claim 1, wherein the safety portion that in a normal undamaged condition of the cam support extends below a lower edge of the side of the housing and in the abnormal condition extends above the lower edge.

3. A door-lock for household appliances, comprising:

a casing having an opening for the insertion of a hook carried by a door of a household appliance, a cam support carrying a cam rotatable between a retaining position and a release position, a locking slider cooperating with the cam and movable between an unlocking position and a locking position, wherein in the locking position the locking slider locks the cam in the retaining position, an electro-magnetic device comprising a housing and a locking pin for locking the locking slider in the locking position, a door sensing slider movable between an open door position and a closed door position, and a hook sensing slider movable between an extracted position and a retracted position, wherein the hook sensing slider has a projection that prevents the movement of the door sensing slider from the open door position towards the closed door position when the hook sensing slider is in the extracted position, wherein the hook sensing slider has:

a safety portion that, in an abnormal condition in which the integrity of the cam support is comprised, comes into contact with a side of the housing and prevents movement of the hook sensing slider from the extracted position towards the retracted position; and a head having a front surface adapted to contact a side of the hook and a top surface is in contact with a portion of an inner surface of the cam support.

4. A door-lock according to claim 3, wherein the safety portion is adjacent to the head.

5. A door-lock according to claim 4, wherein the safety portion has the shape of a rib.

6. A door-lock according to claim 1, wherein during insertion of the hook into the opening of the housing:

when the cam support is uncompromised, the hook sensing slider moves in a first direction; and when the cam support is compromised, the hook sensing slider moves in a second direction.

7. A door-lock according to claim 6, wherein:

movement of the hook sensing slider in the first direction is defined by a linear movement of the hook sensing slider further into the housing while advancing from the extracted position to the retracted position.

8. A door-lock according to claim 6, wherein:

movement of the hook sensing slider in the first direction is defined by a pivot movement of the hook sensing slider that tilts the safety portion of the hook sensing slider against the side of the housing to prevent the movement of the hook sensing slider from the extracted position to the retracted position.

9. A door-lock according to claim 6, wherein:

when the cam support is uncompromised, the cam support: (i) guides movement of the hook sensing slider in the first direction, (ii) prevents movement of the hook sensing slider in the second direction, and when the cam support is compromised, the hook sensing slider is free to move in a second direction.

10. A door-lock according to claim 9, wherein:

when the cam support is uncompromised, the cam support engages an upper surface of the hook sensing slider for guiding movement of the hook sensing slider in the first direction and preventing movement of the hook sensing slider in the second direction.

* * * * *